US009193508B2

(12) United States Patent
Bryant et al.

(10) Patent No.: US 9,193,508 B2
(45) Date of Patent: Nov. 24, 2015

(54) CLOSURE PENDANT TO INDICATE PACKAGE OPENING

(71) Applicant: Owens-Brockway Glass Container Inc., Perrysburg, OH (US)

(72) Inventors: Jessica R. Bryant, Toledo, OH (US); Susan L. Smith, Rossford, OH (US); Mark Bakhrakh, Saint-Petersburg (RU); Igor Kachko, Saint-Peterburg (RU); Vladimir Vasilyev, Saint-Petersburg (RU)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 281 days.

(21) Appl. No.: 13/780,172

(22) Filed: Feb. 28, 2013

(65) Prior Publication Data

US 2014/0237949 A1 Aug. 28, 2014

(51) Int. Cl.
*B65D 55/02* (2006.01)
*B65D 41/04* (2006.01)

(52) U.S. Cl.
CPC ..... *B65D 55/02* (2013.01); *B65D 41/04* (2013.01); *B65D 2101/00* (2013.01)

(58) Field of Classification Search
CPC .... B65D 49/12; B65D 55/02; B65D 41/3495; B65D 51/2871; B65D 51/2885; B65D 55/026; B65D 2101/00
USPC ..... 53/420, 471; 215/250, 258, 366, 365
See application file for complete search history.

(56) References Cited

U.S. PATENT DOCUMENTS

| | | | | |
|---|---|---|---|---|
| 520,219 | A | 5/1894 | Rand et al. | |
| 562,637 | A | 6/1896 | Meyer | |
| 572,329 | A | 12/1896 | Bullard | |
| 588,216 | A * | 8/1897 | Bourke | 215/366 |
| 602,044 | A | 4/1898 | Grapes | |
| 605,227 | A * | 6/1898 | Henry et al. | 215/366 |
| 617,782 | A * | 1/1899 | Smith | 215/250 |
| 641,108 | A | 1/1900 | Hemstreet | |
| 707,759 | A * | 8/1902 | Burns | 215/250 |

(Continued)

FOREIGN PATENT DOCUMENTS

| | | | |
|---|---|---|---|
| DE | 8624488 U1 | 1/1988 | |
| DE | 3631135 A1 * | 3/1988 | B65D 51/2885 |

(Continued)

OTHER PUBLICATIONS

PCT Search Report and Written Opinion, Serial No. PCT/US2014/015551, Filing Date: Feb. 10, 2014, Applicant: Owens-Brockway Glass Container Inc., Mail Date: May 2, 2014, 10 pages.

*Primary Examiner* — Stephen F Gerrity

(57) ABSTRACT

A product includes a closure having a radially inner portion, and being removably securable to a container, and a pendant releasably coupled to the radially inner portion of the closure, and being releasable from the closure into the container upon removal of the closure from the container. A package may include the product and a container, wherein the closure is removably secured to a neck of the container to removably close the container, and the pendant is suspended from the closure in an interior of the container neck, such that when the closure is removed from the container, the pendant releases from the closure and drops into the container and is non-removably carried therein to provide an indication that the package has been opened from its original factory sealed condition.

19 Claims, 3 Drawing Sheets

(56) References Cited

U.S. PATENT DOCUMENTS

| | | | | | |
|---|---|---|---|---|---|
| 749,124 | A | * | 1/1904 | Wright | 215/258 |
| 753,564 | A | * | 3/1904 | Friedmann | 215/365 |
| 759,496 | A | | 5/1904 | Baker et al. | |
| 824,838 | A | | 7/1906 | Atkinson | |
| 956,750 | A | | 5/1910 | Arsac | |
| 962,004 | A | * | 6/1910 | Cassidy | 215/366 |
| 978,712 | A | * | 12/1910 | Drenk | 215/250 |
| 2,032,478 | A | | 3/1936 | Haase | |
| 2,079,125 | A | * | 5/1937 | MacBean | 215/23 |
| 2,144,880 | A | * | 1/1939 | Hellman | 215/366 |
| 2,293,475 | A | * | 8/1942 | Serra | 215/366 |
| 3,256,977 | A | * | 6/1966 | Pettersen | 206/216 |
| 3,326,400 | A | * | 6/1967 | Hamelin et al. | 206/221 |
| 3,399,811 | A | | 9/1968 | Miller | |
| 3,672,533 | A | * | 6/1972 | McKean | 220/745 |
| 4,024,952 | A | * | 5/1977 | Leitz | 206/221 |
| 4,132,308 | A | * | 1/1979 | Goncalves | 206/219 |
| 4,203,517 | A | * | 5/1980 | Hildebrandt et al. | 206/221 |
| 4,377,242 | A | | 3/1983 | Snedker | |
| 4,386,696 | A | | 6/1983 | Goncalves | |
| 4,615,437 | A | * | 10/1986 | Finke et al. | 206/222 |
| 4,733,785 | A | * | 3/1988 | Turner, Jr. et al. | 215/229 |
| 5,785,178 | A | * | 7/1998 | Kvitrud et al. | 206/459.1 |
| 2004/0060831 | A1 | * | 4/2004 | De Laforcade | 206/219 |
| 2007/0262042 | A1 | | 11/2007 | Pareja | |
| 2008/0164286 | A1 | * | 7/2008 | Garcia et al. | 222/321.7 |

FOREIGN PATENT DOCUMENTS

| | | | | | |
|---|---|---|---|---|---|
| DE | 3902280 | A1 | * | 9/1989 | B65D 51/28 |
| FR | 329565 | A | * | 8/1903 | B65D 55/02 |
| FR | 1072927 | A | * | 9/1954 | B65D 51/2885 |
| GB | 191225904 | A | * | 0/1913 | B65D 55/02 |
| GB | 2021522 | A | * | 12/1979 | B65D 49/08 |
| GB | 2371286 | A | | 7/2002 | |
| WO | 2008141367 | | | 11/2008 | |

* cited by examiner

CLOSURE PENDANT TO INDICATE PACKAGE OPENING

The present disclosure is directed to containers and, more particularly, to containers having anti-counterfeit features.

BACKGROUND AND SUMMARY OF THE DISCLOSURE

Many containers are provided with tamper-resistant devices to resist refilling of contents in the containers. For example, a beverage container can include a fitment that renders the container non-refillable, so as to impede efforts to refill the container with inferior products. U.S. Pat. No. 3,399,811 illustrates a container of this type.

A general object of the present disclosure, in accordance with one aspect of the disclosure, is to provide a product including a closure and a package opening indicator carried by the closure and adapted for use with a container to indicate whether the container has been opened and, thus, provide evidence of efforts to repackage the container with counterfeit product.

The present disclosure embodies a number of aspects that can be implemented separately from or in combination with each other.

A product in accordance with one aspect of the disclosure includes a closure having a radially inner portion, and being removably securable to a container, and a pendant releasably coupled to the radially inner portion of the closure, and being releasable from the closure into the container upon removal of the closure from the container.

In accordance with another aspect of the disclosure, there is provided a package that includes the aforementioned product and a container having a body and a neck with an interior, wherein the closure is removably secured to the container neck to removably close the container. The pendant is suspended from the closure in the interior of the container neck, such that when the closure is removed from the container, the pendant releases from the closure and drops into the container and is non-removably carried therein to provide an indication that the package has been opened from its original factory sealed condition.

In accordance with an additional aspect of the disclosure, there is provided a package that includes a container having a body and a neck with an interior, and a closure removably secured to the container neck to removably close the container, and a pendant in the interior of the container neck. The package also includes a means for releasably coupling the pendant to the closure, and a means for releasing the pendant from the closure upon removal of the closure from the container so that the pendant drops into the container and is non-removably carried therein to provide an indication that the package has been opened from its original factory sealed condition.

In accordance with a further aspect of the disclosure, there is provided a method of producing a package that includes coupling a package opening indicator to a closure in a manner such that the pendant is releasable from the closure, filling a container with a flowable product, and applying the closure to the container to suspend the pendant within the container.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
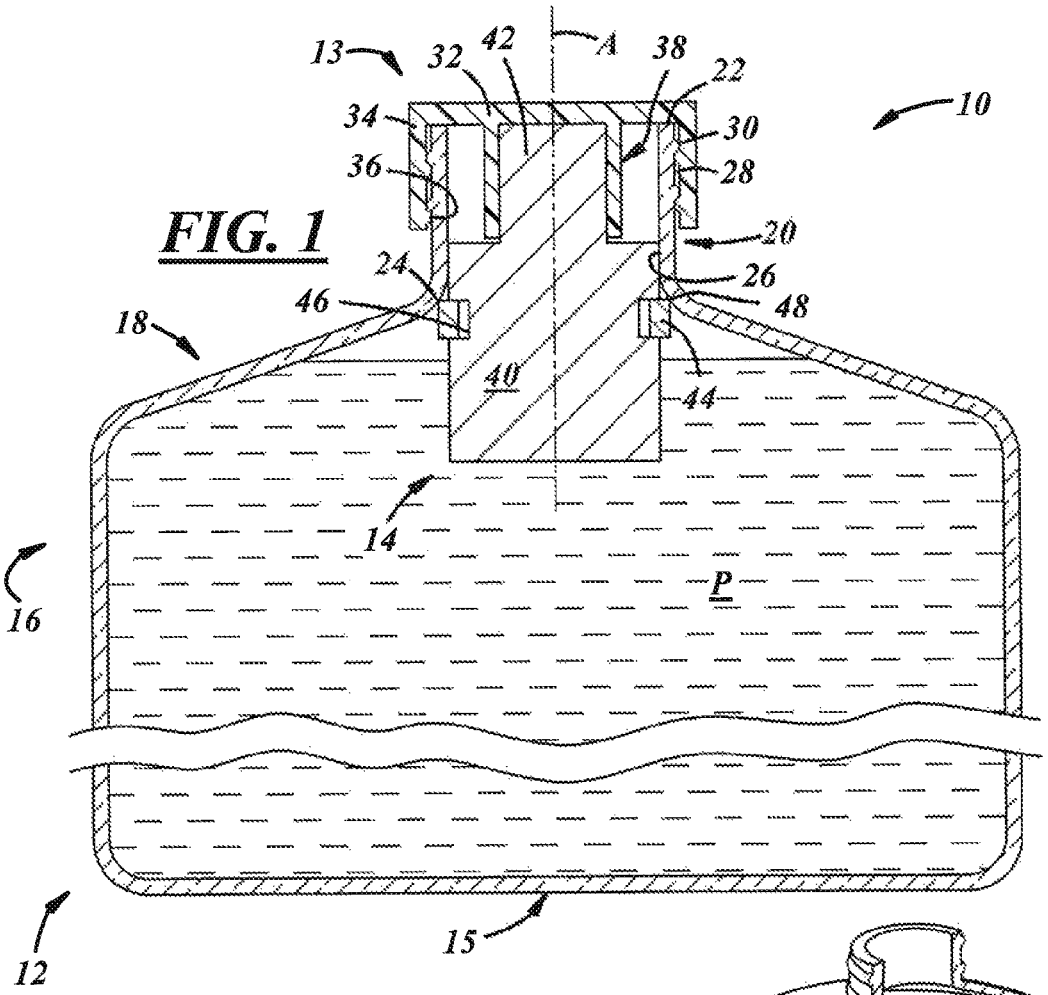
FIG. 1 is a cross-sectional elevational view of a package according to an illustrative embodiment of the present disclosure, including a container, a closure removably secured to the container, and a package opening indicator suspended from a friction retention feature of the closure and positioned within the container.

FIG. 1 illustrates a package 10 in accordance with an illustrative embodiment of the disclosure. The package 10 is illustrated in its original factory sealed state or condition, as including a container 12, a closure 13 for the container 12, and an authentic, genuine, or original material or product P filling the container 12. Additionally, the package 10 may include a package opening indicator in the form of a closure medallion or pendant 14 releasably coupled to the closure 13 and carried by the container 12. As used herein, the phrase "carried by the container" includes carried in the container, carried on the container, coupled to the container, or the like, whether via direct contact with the container 12 and/or via direct contact with the closure 13. As will be described in further detail below, the pendant 14 is a drop-style package opening indicator that drops into the container 12 upon closure removal. As such, the pendant 14 may facilitate evidencing of efforts to tamper with the package 10, by providing visible evidence that the package 10 has been opened from its original factory sealed condition. As used herein, the term "removal" may include partial or complete removal.

The container 12 may be of any suitable shape, and may include a jug, jar, bottle, other food or beverage container, or any other suitable container. The container 12 may include a base 15 on which the container 12 may be supported, a body 16 extending axially from the base 15, a shoulder 18 extending radially and axially from the body 16, and a neck 20 extending axially from the shoulder 18. As used herein, the term axial includes oriented generally along a longitudinal axis of the closure, container, or package and may include but is not limited to a direction that is strictly parallel to a container longitudinal central axis A. The body 16 and the neck 20 may be generally cylindrical, as illustrated, or they may be tapered or of any other suitable shape. The neck 20 may include a lip or axial outward end surface 22, a junction 24 between the shoulder 18 and the neck 20, and an interior surface 26. The neck 20 also may include a finish, which may include an external surface 28, and one or more closure retention elements 30 projecting from the external surface 28, or the like, for cooperation with corresponding portions of the closure 13. The elements 30 may include threads or thread segments, as illustrated, or bayonet features, snap-fit features, or any other suitable closure retention features. As used herein, the term thread segment includes whole, partial, multiple, and/or an interrupted thread, thread segment, and/or lug.

The container 12 may be of one-piece integrally formed construction, for example, of glass, plastic, or any other suitable material. (The term "integrally formed construction" does not exclude one-piece integrally molded layered glass constructions of the type disclosed for example in U.S. Pat. No. 4,740,401, or one-piece glass bottles to which other structure is added after the bottle-forming operation.) The container 12 may be fabricated in press-and-blow, blow-and-blow, or hand blowing glass container manufacturing operations, or in a plastic injection and/or blow molding operation, or in any other suitable manner.

The closure 13 may include a cap, cork, plug, or any other suitable type of closure, and may be composed of plastic, metal, glass, ceramic, or any other suitable material. In any case, the closure 13 includes a radially inner portion to which the pendant 14 is releasably coupled in any suitable manner. Also, according to the illustrated embodiment, the closure 13 may include a base wall 32, an annular outer skirt 34 extending from the base wall 32 and having one or more internal container retention elements 36 projecting from an internal surface thereof for cooperation with corresponding portions of the container 12, and an annular inner skirt 38 extending from the base wall 32 radially inward of the outer skirt 34. The radially inner portion of the closure 13 may be or may include the inner skirt 38, or any portion of the closure 13 that is radially inward of the container neck 20 when the closure 13 is removably secured to the container 12. The elements 36 may include threads or thread segments, as illustrated, or bayonet features, snap-fit features, or any other suitable container retention features. The skirt 38 may be circumferentially continuous or may be circumferentially interrupted.

The pendant 14 may include any suitable materials, components, or the like, and may be carried in any suitable location(s) of the container 12, internally of the container 12. One or more portions of the pendant 14 may be non-removably carried by the container 12, or carried by the container 12 in any other suitable manner. The terminology "non-removably carried" includes a manner in which the pendant 14 is, by design-intent, not intended to be removed from the container 12 without damaging the container 12, the pendant 14, and/or any other portion(s) of the package 10, or otherwise visibly compromising the structural and/or functional integrity of any of the above.

In the illustrated embodiment, the pendant 14 may be composed of plastic, metal, glass, ceramic, and/or any other suitable material, and may include a body 40, a closure coupling portion 42 extending from the body 40, and a resilient portion 44 carried by the body 40. The body 40, closure coupling portion 42, and resilient portion 44 are illustrated as having cylindrical shapes but may have any other suitable shapes. The resilient portion 44 may include a separate component, for example, a resilient ring, carried in an annular groove or relief 46 of the body 40, such that an inner diameter or dimension of the resilient portion 44 is less than an outer diameter or dimension of the body 40 but greater than the groove diameter or dimension. Otherwise, the resilient portion 44 may be integral with the body 40. In any case, the resilient portion 44 may radially overlap, and may be axially trapped between, axially facing shoulders of the body 40 on either side of the groove 46. In one embodiment, the resilient portion 44 may serve to non-removably retain or secure the pendant 14 in the container 12. But in other embodiments, the pendant 14 and/or the container 12 may include any other suitable devices or features to non-removably secure the pendant 14 in the container 12.

The closure coupling portion 42 is releasably coupled to the closure 13 at a radially inner portion thereof. For example, in the illustrated embodiment, the closure coupling portion 42 may be friction fit within the annular inner skirt 38 of the closure 13. But the closure coupling portion 42 may be releasably coupled to the closure 13 (or any other type of closure) by adhesive, integral frangible connectors, snap fit features, tongue and groove, simple detent, interference fit, one or more magnets or separate releasable fasteners, or in any other suitable manner.

The resilient portion 44 is illustrated in a rest state, but when the pendant 14 is assembled to the container 12, the resilient portion 44 is compressible in a radially inward direction to a compressed state to allow the pendant 14 to be inserted into the container neck 20. For example, the resilient portion 44 may be C-shaped or semi-circumferential, having circumferential ends. More specifically, the resilient portion 44 may be a split ring, for instance, a circlip, snap ring, or the like. The resilient portion 44 may be composed of metal, ceramic, polymeric material, or any other suitable resilient material. Also, the resilient portion 44 may be chamfered to facilitate insertion of the pendant 14 into the container neck 20 under a force greater than that supplied by the weight of the pendant 14 alone. The resilient portion 44 is resiliently expandable from the compressed state in a radially outward direction back to the rest state when the resilient portion 44 axially traverses or clears an internal feature of the container 12. For example, the resilient portion 44 may axially clear the junction 24 of the neck 20 and the shoulder 18, whereafter the resilient portion 44 expands resiliently back to its rest state and a trailing surface or edge 48 of the resilient portion 44 is engageable or abutable with the junction 24. At that point, the pendant 14 becomes non-removably carried within the container 12.

In production, the product P may be dispensably disposed within the container 12 of the package 10. For example, a product manufacturer may fill the container 12 with the authentic or original flowable product P at a packaging plant or factory. The product P may include a liquid or flowable solid, for example, a beverage, for instance, beer, wine, liquor, soda, or any other suitable beverage or liquid, or a flowable food of any kind. Thereafter, the container 12 may be closed by the pendant-retaining closure 13. For example, and referring to FIG. 2, a product 11 may include the pendant 14 releasably coupled to the closure 13. The product 11 may be pre-assembled, and then assembled to the container 12 by securing the closure 13 to the container neck 20 in any suitable manner to constitute the package 10. In one example embodiment, the closure 13 may be sealed to the container neck 20 with wax, with a paper or plastic seal, with a portion of the closure 13 itself, with a tamper evidence band, or with any other suitable seal or the like (not separately shown). Accordingly, the package 10 leaves the packaging plant in an original factory sealed condition.

Thereafter, for example, after wholesale distribution or retail sale, the seal may be broken and the closure 13 removed to allow the product P to be dispensed out of the container 12 through the neck 20. When the closure 13 is removed from the container 12, by being displaced in a direction axially away from the base 15 of the container 12, the pendant 14 is lifted or pulled by the closure 12 and the trailing edge 48 of the resilient portion 44 axially engages the junction 24. Continued displacement of the closure 13 axially away from the base 15 of the container 12 results in an applied force that exceeds the frictional forces coupling the pendant 14 to the closure 13 and, thus, causes relative movement between the axially restrained pendant 14 and the moving closure 13. The pendant 14 eventually is released from the closure 13 and drops into the container 12. Therefore, the pendant 14 may be passively or automatically released from the closure 13 in that release of the pendant 14 does not require direct, active manipulation of the pendant 14 to force it to release and drop into the container 12. Thereafter, the pendant 14 will not pass through the container neck 20 because the resilient portion 44 renders it too large to pass therethrough without damage to the container 12 and/or pendant 14. Although the junction 24 is illustrated as an example of the container internal feature, any other suitable internal feature could be used, for example, internal embossments or steps (not shown) of the container neck 20, separate components installed in the neck 20, or any other suitable feature(s) to retain or axially restrain the pendant 14.

Figure 3:
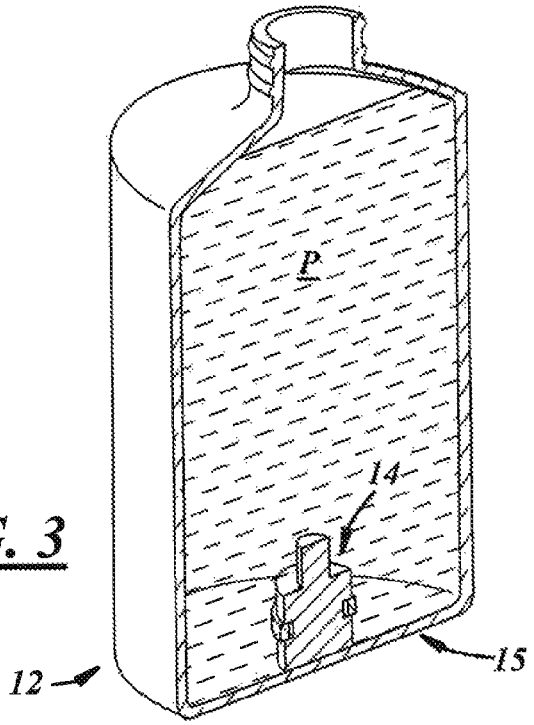
FIG. 3 is a cross-sectional elevational perspective view of the indicator of FIG. 1 shown located in the bottom of the container of FIG. 1.

Referring to FIG. 3, the released pendant 14 may be non-buoyant and, thus, is shown sunk to the bottom 15 of the interior of the container 12. For example, the pendant 14 may be solid and may be composed of a material having a specific gravity greater than that of the product P in the container 12. In any case, the pendant 14 remains with the container 12 during closure removal, and remains in the container 12 after closure removal.

Figure 4:
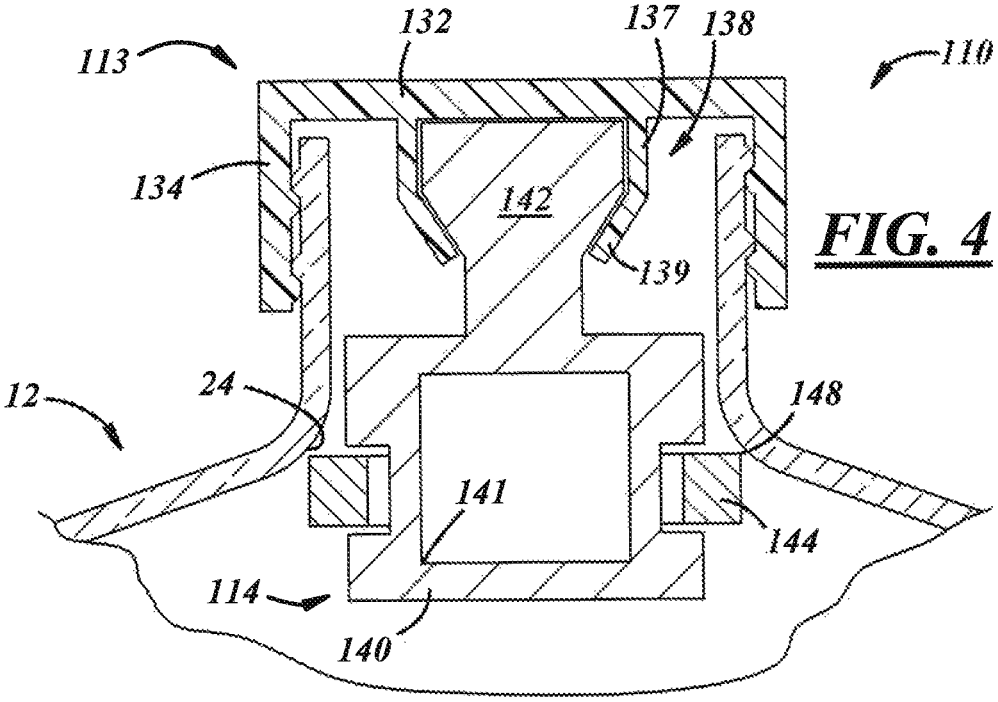
FIG. 4 is a fragmentary cross-sectional view of a package according to another illustrative embodiment of the present disclosure, illustrating a package opening indicator suspended from a positive retention feature of a closure.

FIG. 4 illustrates another example embodiment of a package 110. This embodiment is similar in many respects to the embodiment of FIGS. 1-3 and like numerals between the embodiments generally designate like or corresponding elements throughout the several views of the drawing figures. Accordingly, the descriptions of the embodiments are incorporated into one another, and description of subject matter common to the embodiments generally may not be repeated here.

In this embodiment, the package 110 includes the container 12 of FIG. 1, a closure 113 removably secured to the container 12, and a pendant 114 releasably coupled to the closure 113 to indicate package opening. The closure 113 includes a base wall 132, an outer annular skirt 134 extending axially from the base wall 132, and an inner annular skirt 138 that may be circumferentially continuous or may be circumferentially interrupted. In any case, the skirt 138 includes a first portion 137 extending from the base wall 132, and a second portion 139 extending from the first portion 137. The first and second portions 137, 139 may establish a socket to carry a portion of the pendant 114.

The pendant 114 includes a body 140, which may be hollow with an interior 141. Accordingly, the pendant 114 may be buoyant in liquid product carried by the container 12 when the pendant 114 is released from the closure 113. The pendant 114 also includes a closure coupling portion 142 extending axially from the body 140, and a resilient portion 144 carried by the body 140 and including a trailing edge 148 for cooperation with the junction 24 of the container 12. The closure coupling portion 142 and the skirt 138 may establish a ball-and-socket coupling between the pendant 114 and the closure 113, wherein the closure coupling portion 142 is restrained with the socket established by the skirt 138. The skirt 138 or at least the portion 139 may be circumferentially segmented for flexibility and resilience.

In contrast to the previous embodiment where the coupling was established by a frictional or radial interference fit, this coupling is established by a positive retention feature including a positive interlock between the closure 113 and the pendant 114. More specifically, the positive interlock may include the second portion 139 to axially restrain the closure coupling portion 142 of the pendant 114. In this embodiment, the coupling may or may not also include a frictional or interference fit between the skirt 138 and the pendant coupling portion 142. Those of ordinary skill in the art will recognize that the exact size, shape, and configuration of the skirt 138 and the coupling portion 142 may be varied to provide more or less retention force that must be overcome to release the pendant 114 from the closure 113 upon closure removal.

Figure 5:
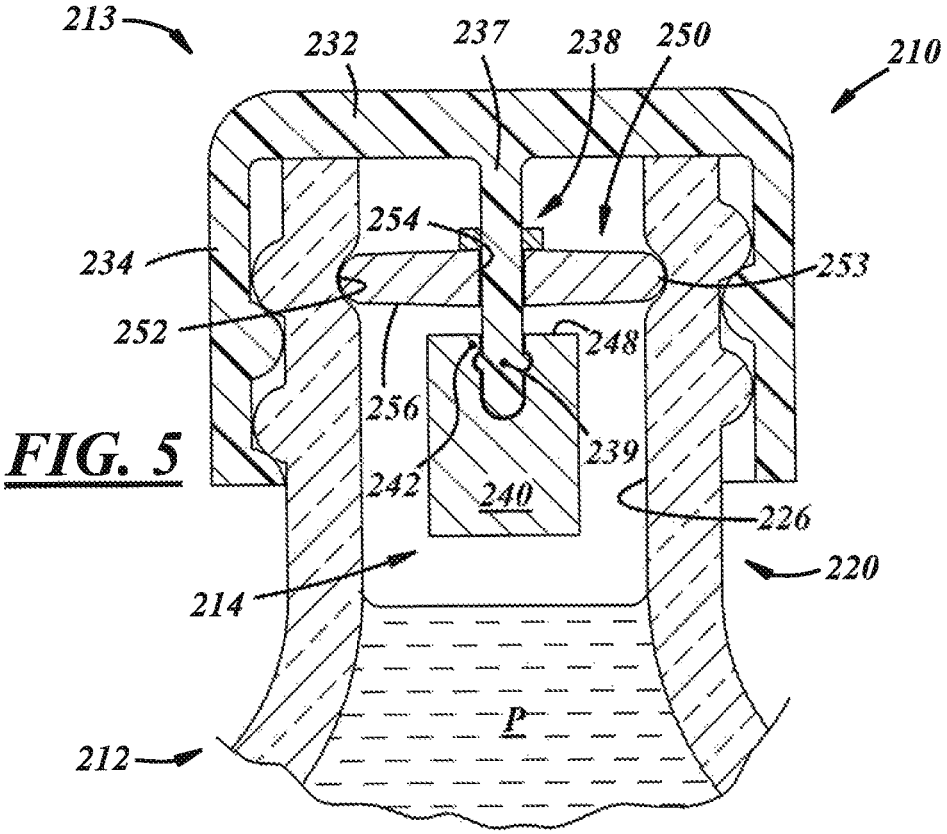
FIG. 5 a fragmentary cross-sectional view of a package according to another illustrative embodiment of the present disclosure, illustrating a package opening indicator suspended from a closure and a stripper extending transversely across a container passage.

FIG. 5 illustrates another illustrative embodiment of a package 210. This embodiment is similar in many respects to the embodiments of FIGS. 1-4 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 210 includes a container 212, a closure 213 removably secured to the container 212, a pendant 214 releasably coupled to the closure 213, and a stripper 250 carried by the container 212 and/or the closure 213. The closure 213 may include a base wall 232, an outer annular skirt 234 extending axially from the base wall 232, and a peg 238 extending from the base wall 232. The peg 238 includes a fixed end 237 that is coupled to the closure base wall 232, extends axially from the closure base wall 232 within the outer annular skirt 234, and has a free end 239 releasably coupled to the pendant 214. The peg 238 also may have a shoulder or carry a fixed washer or the like to facilitate simultaneous assembly of the stripper 250 to the container 212. The pendant 214 may include a body 240 and a closure coupling portion 242 releasably coupled to the free end 239 of the closure peg 238. The coupling portions of the closure 213 and the pendant 214 may include snap fit features, bayonet features, barb features, ball-and-socket features, friction fit features, or any other features suitable for releasable coupling.

The stripper 250 may be carried by the container 212 in an interior of a container neck 220 axially between the pendant 214 and the base wall 232 of the closure 213, wherein when the closure 213 is removed from the container 212, the stripper 250 engages the pendant 214 to strip the pendant 214 away from the closure 213. The stripper 250 may be retained by the container 212 in any suitable manner, for example, in a non-removably carried or secured manner.

For example, the stripper 250 may extend transversely across the interior of the neck 220, and may include an outer annular portion 253 retained within an annular relief 252 in an internal surface 226 of the container neck 220. In other examples, the stripper 250 also or instead may be secured to the container 212 via adhesive, press fit or shrink fit, integral molding, welding, soldering, or secured in any other non-removable manner. Also, or instead, the stripper 250 may be dish shaped and somewhat flexible to facilitate insertion of the stripper 250 in the container 212 and/or registration of a radially outer portion of the stripper 250 within the annular relief 252. The stripper 250 may include a relief 254 therein to accept a portion of at least one of the closure 213 or the pendant 214. The relief 254 may include a hole, passage, slot, gap, or any other suitable void. For example, the peg 238 of the closure 213 may extend completely through the stripper 250 via the relief 254. In addition to the relief 254, the stripper 250 also may include other passages (not shown) therethrough to facilitate dispensing of product through the container neck 220 and out the container 212. Also, the stripper 250 includes an axial abutment surface 256 for engagement or abutment with the pendant 214.

In other embodiments, the stripper 250 may include or carry an anti-refill dispensing fitment, for example, as described in U.S. patent application Ser. No. 13/621,621 entitled FITMENT FOR CONTAINER, which was filed on Sep. 17, 2012 and is assigned to the assignee hereof and is incorporated herein by reference.

In production, the product P may be dispensably disposed within the container 212 of the package 210 and, thereafter, the container 212 may be closed by the pendant-retaining closure 213. For example, the stripper 250 may be assembled over the peg 238 of the closure 213 and then the pendant 214 may be releasably coupled to the peg 238 of the closure 213. The product thus formed may be removably secured to the container 212. For example, the pendant 214 may be centered over the open neck 220 of the container and the closure 213 may be lowered onto and threaded to the container 212 such that the stripper 250 eventually registers into engagement with the relief 252 of the container neck 220. Those of ordinary skill in the art will recognize that the particular sizes, shapes, and configurations of the cooperating portions of the stripper 250 and the container 212 may be application specific, but ensure that the forces retaining the stripper 250 to the container 212 are greater than the forces imposed on the stripper 250 by the pendant 214 when the closure 213 is removed from the container 212.

When the closure 213 is removed from the container 212, by being displaced in a direction axially away from the container 212, the pendant 214 is pulled by the closure 212 and a trailing edge 248 of the pendant 214 axially engages or abuts the axial abutment surface 256 of the stripper 250. Continued displacement of the closure 213 axially away from the container 212 results in an applied force that exceeds the frictional forces coupling the pendant 214 to the closure 213 and, thus, causes relative movement between the axially restrained pendant 214 and the moving closure 213. The pendant 214 eventually is released from the closure 213 and drops into the container 212. Thereafter, the pendant 214 will not pass through the container neck 220 because the stripper 250 blocks its path. In another embodiment, the pendant 214 may be larger and/or may include a resilient portion like that described with respect to FIGS. 1-4 to non-removably secure the pendant 214 in the container 212.

Figure 6:
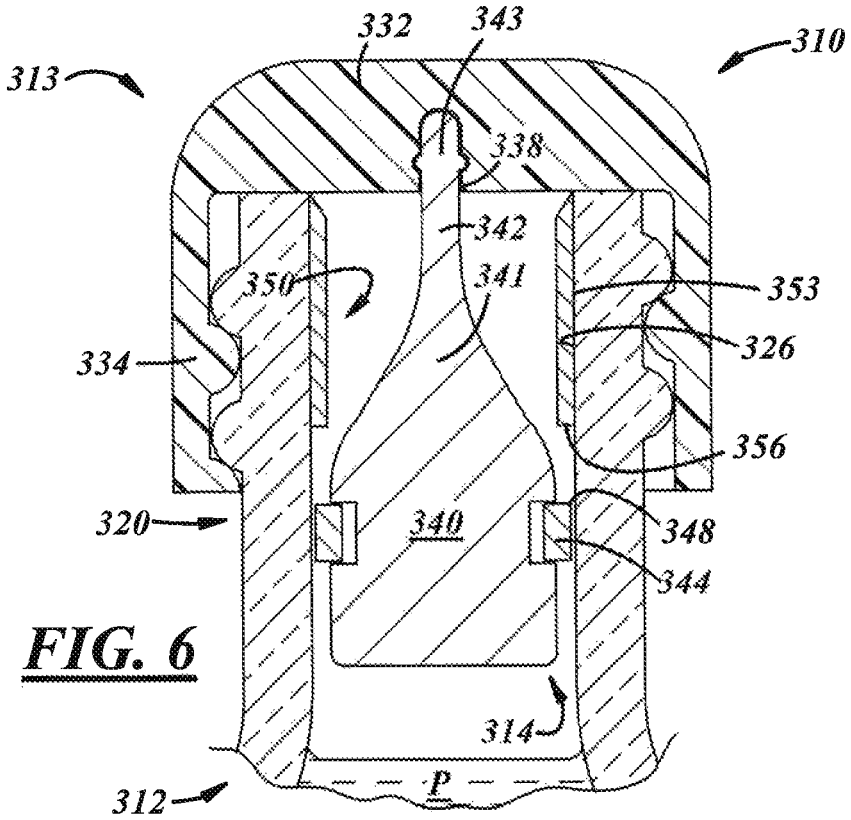
FIG. 6 is a fragmentary schematic view of a package according to a further illustrative embodiment of the present disclosure, illustrating a package opening indicator suspended from a closure and a stripper extending longitudinally along the container passage.

FIG. 6 illustrates another illustrative embodiment of a package 310. This embodiment is similar in many respects to the embodiments of FIGS. 1-5 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 310 includes a container 312, a closure 313 removably secured to the container 312, a pendant 314 releasably coupled to the closure 313, and a stripper 350 carried by the container 312. The closure 313 may include a base wall 332, and an outer annular skirt 334 extending axially from the base wall 332. The pendant 314 may include a body 340, a closure coupling portion 342, and a resilient portion 344 carried by the body 340. The coupling portion 342 may include a projection or peg that has a fixed end 341 coupled to the pendant body 340, extends axially from the pendant body 340, and has a free end 343 releasably coupled to the closure base wall 332.

The stripper 350 may be carried by the container 312 in an interior of a container neck 320 axially between the pendant 314 and the base wall 332 of the closure 313, wherein when the closure 313 is removed from the container 312, the stripper 350 engages the pendant 314 to strip the pendant 314 away from the closure 313. The stripper 350 may extend axially along an interior surface 326 of the neck 320, and may include a hollow column with an exterior surface 353 in contact with the interior surface 326 of the neck 320. The stripper 350 also may include an axial abutment surface 356 to engage the resilient portion 344 of the pendant 314 upon removal of the closure 313 from the container 312. Again, in other embodiments, the stripper 350 may include or carry an anti-refill fitment as mentioned above.

The stripper 350 may be retained in the container 312 in any suitable manner. For example, the stripper 350 may be non-removably carried by the container 312, for instance, via an interference fit, for example, press-fit, shrink-fit, or the like. The fit between the outer surface 353 of the stripper 350 and the corresponding interior surface 326 of the container neck 320 may be tight, wherein the stripper 350 cannot be removed without causing visible damage to the container 312. For example, the outer surface 353 of the stripper 350 may be larger than the corresponding interior surface 326 of the container 312 when both the stripper 350 and the container 312 are at the same temperature.

In one embodiment, before assembly, the stripper 350 may be at a relatively cooler temperature than the container 312. In one example of this embodiment, before assembly, the stripper 350 can be cooled to reduce its radially outer size, and the container 312 can be heated to increase its radially inner size. Then, the stripper 350 can be inserted into the container 312 to its desired axial position, and then as the stripper 350 warms up and the container 312 cools down, the radially outer size of stripper 350 expands into a tight fit with the corresponding contracting portion of the container 312.

In other embodiments, only the stripper 350 may be cooled, or only the container 312 may be warmed, and then the stripper 350 may be assembled to the container 312. Thereafter, expansion of the stripper 350 or contraction of the container 312 result in the interference fit.

In another embodiment, the stripper 350 may be press fit to the container 312. For example, the stripper 350 and the container 312 may be at the same or similar temperature, and the stripper 350 pressed into the container 312. Of course, care must be taken in the selection of the materials, wall thicknesses, and the like, to ensure that the hoop stresses are not so high that such press fitting breaks the container 312.

In a further embodiment, any combination of the aforementioned embodiments may be used.

It is believed that friction and/or surface tension between the stripper 350 and the container resulting from the interference fit will sufficiently secure the stripper 350 in place and render the stripper 350 tamper-evident because attempts to remove the stripper 350 should result in visible damage or breakage of the container and/or fitment. But other engagement features could be added such as barbs on the exterior of the stripper 350 that could press into certain container materials, like plastic, and cause visible damage to the container if the stripper 350 were removed or removal was attempted.

When the closure 313 is removed from the container 312, by being displaced in a direction axially away from the container 312, the pendant 314 is pulled by the closure 312 and a trailing edge 348 of the pendant 314 axially engages or abuts the axial abutment surface 356 of the stripper 350. Continued displacement of the closure 313 axially away from the container 312 results in an applied force that exceeds the frictional forces coupling the pendant 314 to the closure 313 and, thus, causes relative movement between the axially restrained pendant 314 and the moving closure 313. The pendant 314 eventually is released from the closure 313 and may drop into the container 312. Thereafter, the pendant 314 will not pass through the container neck 320 because the stripper 350 blocks its path.

Figure 7:
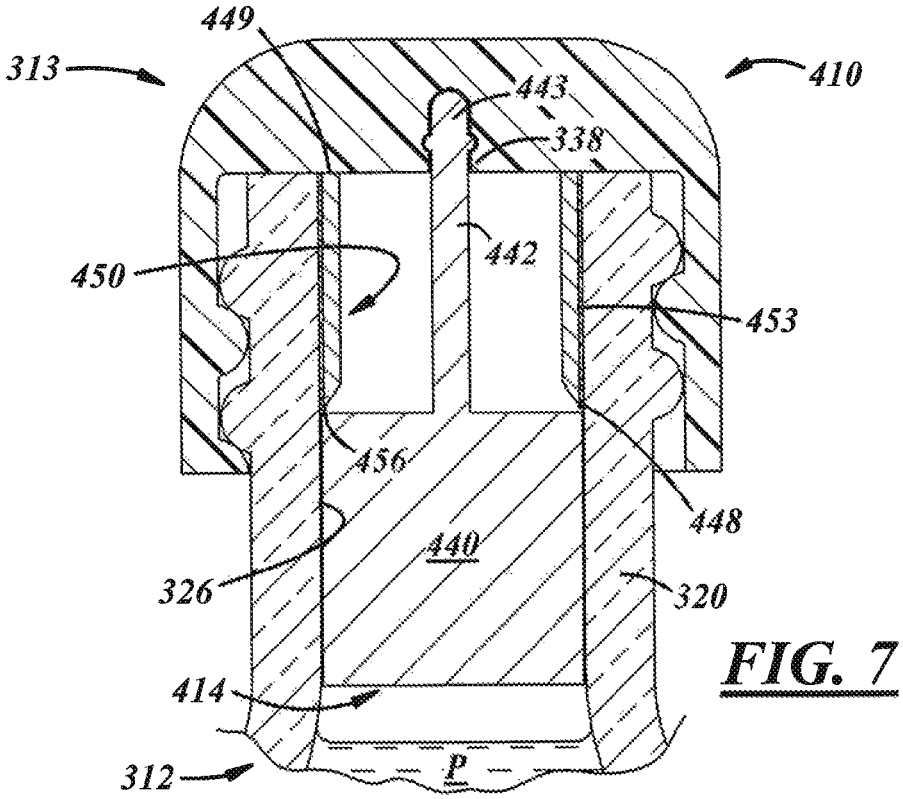
FIG. 7 is a fragmentary schematic view of a package according to an additional illustrative embodiment of the present disclosure, illustrating a package opening indicator suspended from a closure and a stripper extending longitudinally along the container passage.

FIG. 7 illustrates another illustrative embodiment of a package 410. This embodiment is similar in many respects to the embodiments of FIGS. 1-6 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 410 includes the container 312 and the closure 313 of FIG. 6, a pendant 414 releasably coupled to the closure 313, and a stripper 450 non-removably carried by the container 312. The pendant 414 includes a body 440, and also may include a closure coupling portion 442 having a free end 443 releasably coupled to the closure 313, for instance via the closure coupling 338. In this embodiment, the pendant 414 need not include a resilient portion carried by the body 440. Instead, the body 440 itself may cooperate with the stripper 450 as described below. The stripper 450 may be carried by the container 312 in the container neck interior axially between the pendant 414 and the closure 313. The stripper 450 may extend axially along the interior surface 326 of the neck 320, and may include a hollow column with an exterior surface 453 in contact with the interior surface 326 of the neck 320. The stripper 450 also may include an axial abutment surface 456 to engage an axial abutment 448 of the pendant body 440 upon removal of the closure 313 from the container 312.

The stripper 450 may be retained in the container 312 in any suitable manner. For example, the stripper 450 may be non-removably carried by the container 312, for instance, via an interference fit, as described with respect to the stripper 350 of FIG. 6. In another example, the stripper 450 may be adhered to the interior of the container neck with any suitable adhesive(s). In other examples, the stripper 450 may be permanently fixed or non-removably carried by the container 312 in any other suitable manner.

In one embodiment, the stripper 450 may be assembled to the container 312 simultaneously with the pendant 414. For example, the stripper 450 may include a coupling end 449 that may be temporarily adhered to, staked in, or otherwise releasably coupled to, the closure 313. In other embodiments, the stripper 450 and/or the pendant 414 may be configured, individually or cooperatively, for any suitable sequence of assembly. In any case, when the closure 313 is removed from the container 312, the stripper 450 engages the pendant 414 to strip the pendant 414 away from the closure 313, and the pendant 414 may drop into the container 312.

Figure 2:
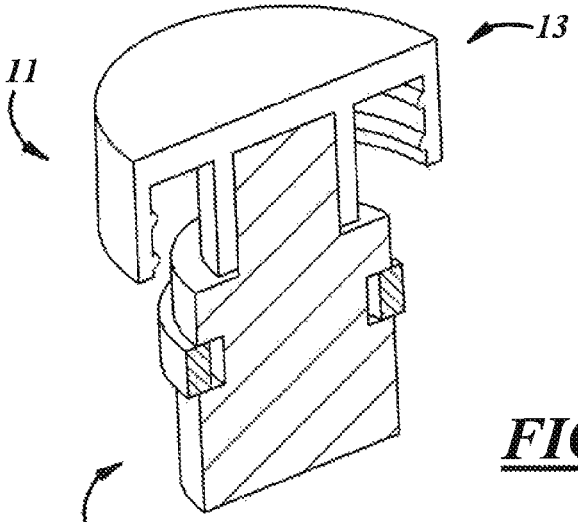
FIG. 2 is an enlarged fragmentary cross-sectional perspective view of a product including the closure and indicator of FIG. 1.

In accordance with the above embodiments, there are disclosed and illustrated several means for releasably coupling a pendant to a closure, including, for example, elements 38, 42 of FIGS. 1-3, elements 138, 142 of FIG. 4, elements 238, 240 of FIG. 5, elements 338, 342 of FIG. 6, and elements 338, 442 of FIG. 7. Additionally, or instead, the pendant may be releasably coupled to the closure by any other means, including adhesive, integral frangible connectors, snap fit features, one or more magnets or separate releasable fasteners, or the like, or in any other suitable manner.

Also in accordance with the above embodiment, there are disclosed and illustrated several means for passively releasing the pendant from the closure upon removal of the closure from the container, including, for example, elements 24, 44 of FIGS. 1-3, elements 24, 144 of FIG. 4, elements 250, 252 of FIG. 5, elements 344, 350 of FIG. 6, and elements 440, 450 of FIG. 7. Also, or instead, the pendant may be released by any other passive means, including a threaded engagement between the pendant and the closure that is circumferentially shorter than the threaded engagement between the closure and the container, or the like, or in any other suitable manner.

According to other embodiments of the present disclosure, there are provided methods of producing and using a package. A method of producing a package may include coupling a pendant to a closure in a manner such that the pendant is releasable from the closure, filling a container with an original flowable product, and applying to the container the closure having the pendant releasably coupled thereto to suspend the pendant into the container. The method also may include coupling a stripper to the closure and/or the container to strip the pendant from the closure upon closure removal from the container. The method further may include coupling a stripper to the closure in a releasable manner, and coupling the stripper to an interior of the container such that the stripper is non-removably carried in the container, and such that the closure is releasable from the stripper when the closure is removed from the container.

A method of using the package produced by the method above may include removing the closure from the container to passively release the pendant from the closure during closure removal so that the pendant drops into the container. The pendant may be passively released from the closure wherein the pendant is stripped away from the closure, for example, by axial abutment between the pendant and the stripper, or by axial abutment between a portion of the pendant and a corresponding portion of the container, and/or the like.

There thus has been disclosed a product, a package, and methods that fully satisfy all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. For example, the subject matter of each of the embodiments is hereby incorporated by reference into each of the other embodiments, for expedience. The disclosure is intended to embrace all such modifications and variations as fall within the spirit and broad scope of the appended claims.

The invention claimed is:

1. A product that includes:

a closure having an annular outer skirt and a radially inner portion located radially inwardly of the outer skirt, and being removably securable to a container; and a pendant releasably coupled to the radially inner portion of the closure, and being releasable from the closure into the container upon removal of the closure from the container, and wherein the pendant includes a hollow body with an interior to render the pendant buoyant.

2. The product set forth in claim 1, wherein the closure includes a base wall and the outer skirt extending axially from the base wall, and an inner annular skirt extending axially from the base wall within the outer annular skirt, and the pendant is releasably coupled to the base wall in a location radially within the inner annular skirt.

3. The product set forth in claim 2, wherein the pendant includes a coupling portion releasably coupled to the inner annular skirt.

4. The product set forth in claim 2, wherein the inner annular skirt establishes a socket, and wherein the pendant includes a coupling portion that is restrained within the socket.

5. The product set forth in claim 2 wherein the closure includes a peg that has a fixed end coupled to the closure base wall, extends axially from the closure base wall within the outer annular skirt, and has a free end releasably coupled to the pendant.

6. The product set forth in claim 2 wherein the pendant includes a body, and a peg that has a fixed end coupled to the pendant body, extends axially from the pendant body, and has a free end releasably coupled to the closure base wall.

7. A package that includes the product of claim 1 and a container having a body and a neck with an interior, wherein the closure is removably secured to the container neck to removably close the container, and the pendant is suspended from the closure in the interior of the container neck, such that when the closure is removed from the container, the pendant releases from the closure and drops into the container and is non-removably carried therein to provide an indication that the package has been opened from its original factory sealed condition.

8. The package set forth in claim 7 that includes an axial abutment in the container neck, and the pendant includes a radially resilient element that is axially abutable with the axial abutment when the closure is removably secured to the container neck and prevents removal of the pendant through and out of the neck.

9. The package set forth in claim 7 wherein the container also includes a base from which the body extends in a direction axially away, a shoulder extending in a direction axially away from the body and from which the neck extends in a direction axially away, and an axial abutment, wherein the neck includes a neck finish and an interior surface, and wherein the pendant also includes a resilient portion that is compressible to allow insertion of the pendant into the container neck and expandable to abut the axial abutment, wherein the pendant is positioned in the neck of the container such that if the pendant is pulled in an axial outward direction away from the container base, then the resilient portion abuts the axial abutment such that continued displacement of the pendant away from the base results in the pendant dropping into the container body.

10. The package set forth in claim 7 wherein the pendant is buoyant in liquid product carried by the container when the pendant is released from the closure.

11. The package set forth in claim 7 that includes a stripper carried by the container in the interior of the neck axially between the pendant and the closure, wherein when the closure is removed from the container, the pendant abuts the stripper to strip the pendant away from the closure.

12. The package set forth in claim 11, wherein the stripper extends transversely across the interior of the neck.

13. The package of claim 11, wherein the stripper extends axially along the interior of the neck.

14. The package of claim 13, wherein the stripper includes a hollow column non-removably carried within the interior of the neck.

15. The package of claim 14, wherein the pendant includes a body and a resilient portion carried by the body for abutment with the stripper upon removal of the closure from the container.

16. The package of claim 14, wherein the pendant includes a body for abutment with the stripper upon removal of the closure from the container.

17. The package of claim 16, wherein the hollow column is releasably coupled to the closure.

18. A product that includes:

a container having a body, a neck with an interior, a base from which the body extends in a direction axially away, a shoulder extending in a direction axially away from the body and from which the neck extends in a direction axially away, and an axial abutment, wherein the neck includes a neck finish and an interior surface;

a closure having a radially inner portion, and being removably securable to a container, wherein the closure is removably secured to the container neck to removably close the container;

a pendant releasably coupled to the radially inner portion of the closure, and being releasable from the closure into the container upon removal of the closure from the container, wherein the pendant is suspended from the closure in the interior of the container neck, such that when the closure is removed from the container, the pendant releases from the closure and drops into the container and is non-removably carried therein to provide an indication that the package has been opened from its original factory sealed condition, and wherein the pendant also includes a resilient portion that is compressible to allow insertion of the pendant into the container neck and expandable to abut the axial abutment, wherein the pendant is positioned in the neck of the container such that if the pendant is pulled in an axial outward direction away from the container base, then the resilient portion abuts the axial abutment such that continued displacement of the pendant away from the base results in the pendant dropping into the container body; and a stripper carried by the container in the interior of the neck axially between the pendant and the closure, wherein when the closure is removed from the container, the pendant abuts the stripper to strip the pendant away from the closure, wherein the stripper extends transversely across the interior of the neck and includes a relief extending therethrough to accept a portion of at least one of the closure or the pendant.

19. The package set forth in claim 18 wherein the pendant is non-buoyant in liquid product carried by the container when the pendant is released from the closure.

* * * * *